United States Patent [19]
Morris
[11] 4,164,727
[45] Aug. 14, 1979

[54] UNDERWATER ACOUSTIC ABSORBER

[75] Inventor: Ross E. Morris, Vallejo, Calif.

[73] Assignee: The United States of America as represented by the Secretary of the Navy, Washington, D.C.

[21] Appl. No.: 788,730

[22] Filed: Apr. 14, 1977

[51] Int. Cl.[2] ..... G10K 11/00
[52] U.S. Cl. ..... 340/5 D; 181/0.5; 181/284
[58] Field of Search ..... 181/207, 208, 209, 284, 181/286, 290, 291, 292, 293, 294, 295, 0.5; 340/5 D, 8 FT

[56] References Cited

U.S. PATENT DOCUMENTS 2,811,216 10/1957 Harris ..... 181/286
3,130,700 4/1964 Peterson ..... 340/5 D X

FOREIGN PATENT DOCUMENTS 963958 7/1964 United Kingdom ..... 181/292

*Primary Examiner*—Richard A. Farley
*Attorney, Agent, or Firm*—R. S. Sciascia; Charles D. B. Curry; Francis I. Gray

[57] ABSTRACT

An underwater acoustic absorber and reflector having an impervious rigid metal bonded to a rubber tile. When installed on baffle plates of an underwater vehicle the absorber maintains its efficiency under hydraulic pressure.

1 Claim, 4 Drawing Figures

UNDERWATER ACOUSTIC ABSORBER

BACKGROUND OF THE INVENTION

1. Field of the Invention

The present invention relates to acoustic absorbers, and more particularly to underwater acoustic absorbers subjected to hydraulic pressure.

2. Description of the Prior Art

The present construction of underwater acoustic absorbers and reflectors subjected to hydraulic pressure consists of a rubber sheet or slab having a pattern of cavities, usually cylindrical, with the axes of the cavities perpendicular to the face of the sheet or slab. The air-filled cavities are closed on one end by on overlayer of rubber, typically 3/16 inch thick, and on the other end by rubber or the substrate. The absorber is then affixed to baffle plates by an adhesive, a time-consuming process. FIG. 1 illustrates an acoustic absorber with the cavities closed on both ends by rubber. The disadvantage of this construction is the tendency of the rubber overlayer to collapse into the cavity when the absorber or reflector is subjected to hydraulic pressure.

The collapsing of the overlayer into the cavities usually affects the acoustic impedance of the absorber or reflector in such a manner that it performs less efficiently, typically an efficiency drop from 90% to 73% at the optimum absorption frequency is observed when subjected to hydraulic pressure. Also, the collapsing of the overlayer into the cavities and the compression of the rubber body between the cavities causes the air pressure in the cavities to rise above atmospheric. The compressed air diffuses into the rubber and eventually escapes into the ambient water. A large proportion of the air in the cavities may be lost by this process if the hydraulic pressure is maintained for a long period or reapplied repeatedly. Since the air in the cavities provides part of the acoustic compliance of the absorber or reflector, its loss may produce a permanent decrease in the acoustic efficiency of the absorber or reflector.

SUMMARY OF THE INVENTION

Accordingly, the present invention provides an underwater acoustic absorber and reflector wherein a rubber sheet or slab having cavities therein is faced with impervious, essentially rigid sheets which close off the cavities. The resulting absorber or reflector is then attached to baffle plates by studs, bolts or rivets.

STATEMENT OF THE OBJECTS OF THE INVENTION

Therefore, it is an object of the present invention to provide underwater acoustic absorbers and reflectors having an improved efficiency when subjected to hydraulic pressure.

Another object of the present invention is to provide underwater acoustic absorbers and reflectors which can be easily and securely attached to baffle plates.

DESCRIPTION OF THE PREFERRED EMBODIMENT

Figure 1A:
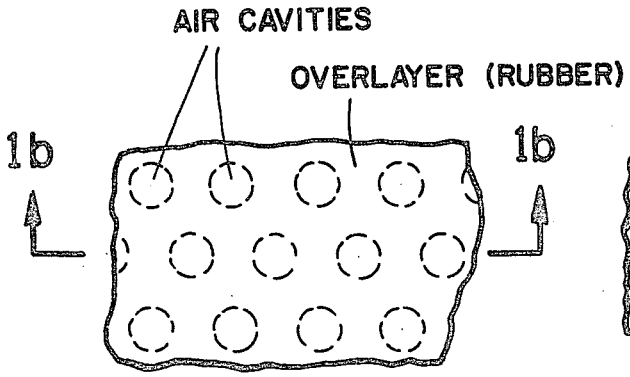
FIG 1a (PRIOR ART)
FIG. 1*a* is a plan view of a prior art underwater acoustic absorber.
Figure 1B:
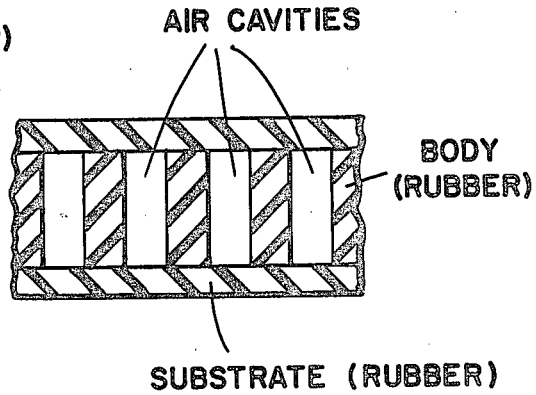
FIG 1b (PRIOR ART)
FIG. 1*b* is a sectional view taken along line I—I of the prior art underwater acoustic absorber.
Figure 2A:
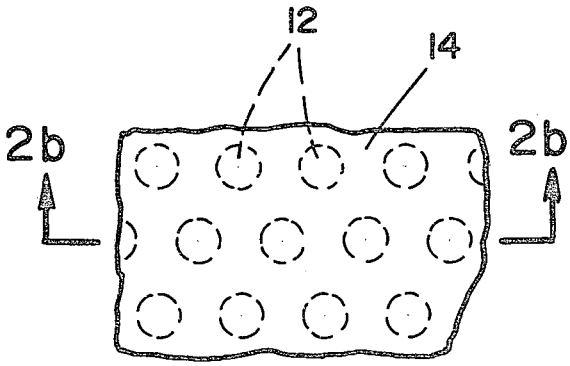
FIG. 2*a* is a plan view of an underwater acoustic absorber according to the present invention.
Figure 2B:
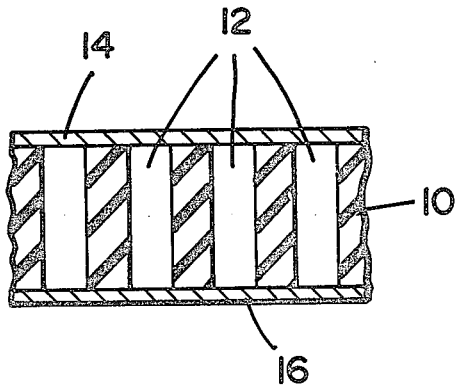
FIG. 2*b* is a sectional view taken along line II—II of the underwater acoustic absorber according to the present invention.

Referring now to FIG. 2 an underwater acoustic absorber and reflector has a body 10 in the form of a rubber sheet or slab having a plurality of holes 12 therethrough. The holes 12 may be approximately cylindrical in shape with the cylindrical axes perpendicular to the faces of the body 10, which faces are approximately parallel to each other. The holes 12 may be evenly spaced throughout the body 10. An overlayer 14 and a substrate 16 of an impervious, essentially rigid, metal material in the form of sheets are firmly bonded to the opposing faces of the body 10 such that the holes 12 become air cavities. The metal is generally steel or corrosion resisting steel with a sheet thickness no greater than needed for rigidity, typically 1/16 inch.

In this construction the amount of collapse of the overlayer into the cavities due to hydraulic pressure is insignificant, and the metal forms an impermeable barrier to loss of air from the cavity. The acoustic properties show less change when subjected to hydraulic pressure dwell, with the efficiency at the optimum absorption efficiency remaining at 93% before and after pressure dwell.

Because of the rigidity, steel-faced acoustic absorbers and reflectors can be easily and securely attached to metal baffle plates by means of threaded studs, bolts or rivets.

Thus, the present invention provides an underwater absorber and reflector which maintains its efficiency when subjected to hydraulic pressure, and which can be more easily installed on baffle plates.

What is claimed is:

1. An underwater acoustic absorber and reflector comprising:

(a) a body having a single unlayered piece of resilient material with opposing faces, said body having a plurality of holes therethrough between said faces;

(b) an overlayer of thin corrosion resistant steel bonded to one face of said body; and (c) a substrate of thin corrosion resistant steel bonded to the opposite face of said body whereby said holes are enclosed to form cavities.

* * * * *